United States Patent [19]

Trost

[11] 4,022,250

[45] May 10, 1977

[54] RAPIERS WITH GUIDE MEANS FOR USE IN A VERTICAL WEAVING MACHINE

[75] Inventor: Wayne C. Trost, Rockford, Ill.

[73] Assignee: Barber-Colman Company, Rockford, Ill.

[22] Filed: May 14, 1976

[21] Appl. No.: 686,651

[52] U.S. Cl. ..... 139/18; 139/448; 139/DIG. 1

[51] Int. Cl.[2] ..... D03D 47/18

[58] Field of Search ..... 139/441, 443–448, 139/18, DIG. 1

[56] References Cited

UNITED STATES PATENTS

| | | | |
|---|---|---|---|
| 1,355,320 | 10/1920 | Entwisle | 139/441 |
| 2,813,548 | 11/1957 | Dewas | 139/448 |
| 3,390,707 | 7/1968 | Scherillo | 139/448 |

*Primary Examiner*—Henry S. Jaudon
*Attorney, Agent, or Firm*—Robert M. Hammes, Jr.

[57] ABSTRACT

The entry and exit rapiers of a weft inserting mechanism in a vertical weaving machine have guide means for contacting the sheets of warp strands which form a shed during the weaving of fabric so that lateral movement of the rapiers is inhibited while they are traveling weft-wise between the sheets. One rapier also has an associated clip guide for engaging the other rapier to prevent substantial vertical divergence of the rapiers as they come together so as to facilitate transfer of the weft yarn from the entry rapier to the exit rapier.

16 Claims, 9 Drawing Figures

RAPIERS WITH GUIDE MEANS FOR USE IN A VERTICAL WEAVING MACHINE

BACKGROUND OF THE INVENTION

This invention relates to the weft inserting mechanism of a vertical weaving machine. In particular, the invention concerns stabilization of the entry and exit rapiers during the weft insertion operation.

The rapiers in a weaving machine are typically composed of an elongated tubular section having a thread carrying head which travels into and out of the warp shed during the weft inserting operation. Depending on the amount of support provided along the length of the rapier, the rapier head experiences varying degrees of random movements in combinations of horizontal and vertical directions transverse to the longitudinal movement of the rapier while the rapier is traveling in the warp shed. In standard looms having a generally horizontal configuration the rapiers are supported along their entire length during the weft inserting operation since they rest on a warp sheet supported by the lay of the machine while traveling in the shed. The situation is considerably different in weaving machines having a vertical configuration such as those currently being developed for weaving triaxial fabric of the type disclosed in U.S. Pat. No. Re. 28,155 and U.S. Pat. No. 3,874,422 both issued to Norris F. Dow. Weaving machines constructed with a vertical configuration do not readily lend themselves to providing mechanical supports for the rapiers as is done in standard horizontal looms. In vertical weaving machines the rapiers are cantilevered in such fashion that the weft carrying head is totally unsupported and is susceptible to random transverse movement while traveling in the shed. In order to attain successful transfer to the weft yarn from the entry rapier to the exit rapier it is essential that the rapiers come precisely together. The inherent instability of the cantilevered rapiers can result in misalignment of the rapiers at the weft transfer point and consequently the exit rapier fails to grip the weft yarn. This results in a flaw in the fabric. A similar result occurs if the rapier runs into an out of place warp yarn. Since the rapier head is relatively free, it will generally be deflceted by the warp yarn and consequently there is a missed transfer. When there is a missed transfer the machine is stopped by a stop motion device and the weft yarn must then be inserted manually. To obtain high efficiency the number of stops must be minimized. It is also possible that the entry and exit rapiers can collide resulting in substantial damage to the rapiers. It is thus desirable to obtain a degree of rapier stabilization which assures accurate mating of the rapiers and successful transfer of the weft yarn from the entry rapier to the exit rapier.

Increased rapier stabilization can be obtained by using larger, stiffer rapier tubes or an I-beam cross-section for the rapier but this would result in an undesirable increase in cost, weight and power requirements. It is also possible to provide a guide means for the rapiers on the machine itself but this would unduly complicate the machine construction. The invention disclosed herein provided an inexpensive means for stabilizing the rapiers which does not require any changes in the machine construction.

SUMMARY OF THE INVENTION

The rapirs of a vertical weaving machine travel weft-wise in a horizontal plane during weft insertion. The random movements of the rapier heads previously discussed are a combination of movements in the horizontal and vertical planes transverse to the longitudinal movement of the rapiers. According to the invention the sheets of warp strands which form a shed are utilized to provide horizontal stabilization. The entry and exit rapiers are so constructed that a portion of each rapier contacts the warp strand sheets on either side of the rapiers. Since the sheets form limiting boundaries for the rapiers, lateral movement in the horizontal plane is inhibited. Further, the invention utilizes the warp strand sheets to inhibit movement in the vertical direction since the sheets come together to form a V at the fell thus forming a limiting boundary for downward vertical movement. This also has a dampening effect on overall vertical movement.

In order to insure that upward vertical movement does not cause the exit rapier to miss the weft yarn when the two rapiers come together for transfer of the yarn, means associated with one of the rapiers is provided to limit vertical divergence of the rapier heads at the transfer point.

Utilizing the warp strand sheets to stabilize the rapiers as they travel in the shed provides a structurally simple and inexpensive way to accomplish the required amount of stabilization. It can be accomplished by slight modifications in commercially available rapiers, thus eliminating the need for, and expense of, specially manufactured rapiers of heavier, stiffer construction. This stabilizing effect, along with the means to insure vertical proximity of the rapiers at transfer, greatly reduce the number of machine stops and thus an overall increase in weaving efficiency is obtained.

DESCRIPTION OF THE INVENTION

Figure 1:
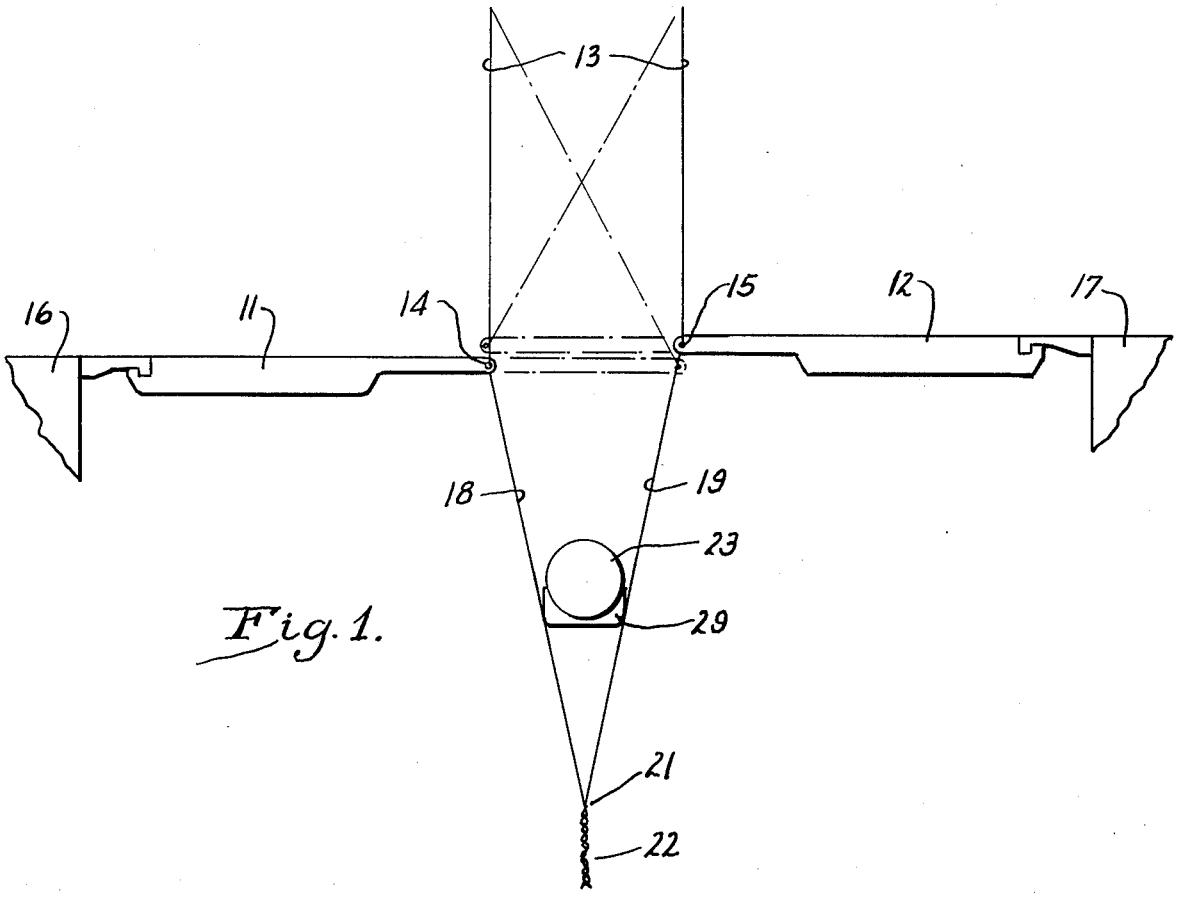
FIG. 1 is a partial end view of a weaving machine showing a warp shed and a weft yarn carrying rapier with guide means in the shed.

In a typical vertical machine for weaving fabric, warp strands are guided by opposed sets of a plurality of elongated heddles spaced laterally weft-wise in the machine. The heddles are positioned longitudinally by a shedding means so as to arrange the warp strands into sheets which form substantially vertically oriented warp sheds as shown in FIG. 1. The operation and construction of a suitable shedding means is described in a copending application, Ser. No. 687,012 filed May 17, 1976 which is of common ownership with this application. Said copending application is hereby incorporated by reference to explain in detail the shed forming operation.

Figure 2:
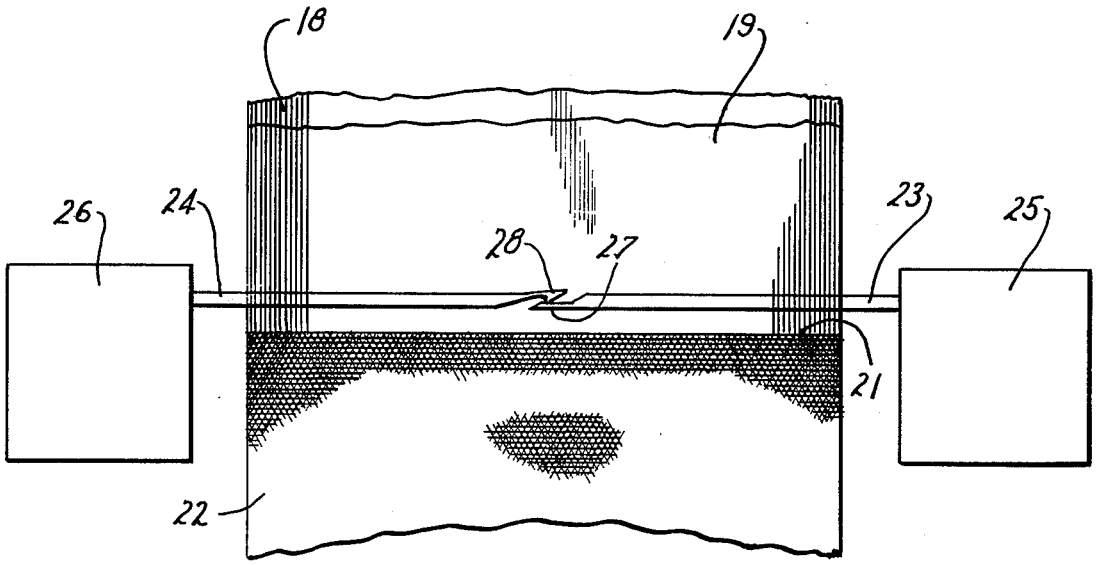
FIG. 2 is a front view, partially broken away, schematically showing the weft yarn insertion apparatus of a triaxial weaving machine.

Referring now to FIG. 1, two sets of opposing heddles 11, 12 have warp strands 13 running through closed eyes 14, 15. Shedding means 16, 17 selectively position the heddles in either retracted (shown by solid lines) or extended (shown by phantom lines) positions to form the sheds into which weft yarns are inserted during weaving of fabric. The opposing sheets 18, 19 of warp strands come together at the fell line 21 of the woven fabric 22. When a shed is formed a weft yarn (not shown) is inserted into the shed by a weft-wise travelling entry rapier 23. In the shed, as shown in FIG. 2, the weft yarn is transferred to exit rapier 24 and is pulled through the shed as rapiers 23, 24 are retracted from the shed. After insertion the weft-yarn is beaten down to the fell line 21 by a suitable beater mechanism (not shown). Heddles 11, 12 are then repositioned by shedding means 16, 17 to form another shed and the weft insertion process is repeated.

FIG. 2 shows the warp strand sheets 18, 19 which come together at the fell line 21 of the woven fabric 22. Entry rapier 23 and exit rapier 24 are shown inserted to the point of weft-yarn transfer in the shed. Rapier inserting means 25, 26 control the insertion and retraction of entry rapier 23 and exit rapier 24 respectively. As is apparent from FIG. 2, rapiers 23, 24 are supported in cantilever fashion by rapier inserting means 25, 26. Due to this cantilevered construction the weft-carrying rapier heads 27, 28 of rapirs 23, 24 experience varying degrees of random transverse movement while travelling into and out of the shed. This instability can cause misalignment of entry rapier 23 and exit rapier 24 when they come together for transfer of the weft yarn. The result may be a missed transfer or possibly a collision of rapiers 23, 24. In order to prevent these occurrences it is necessary to provide some means for stabilizing the rapier heads 27, 28 as they travel in the shed.

Figure 3:
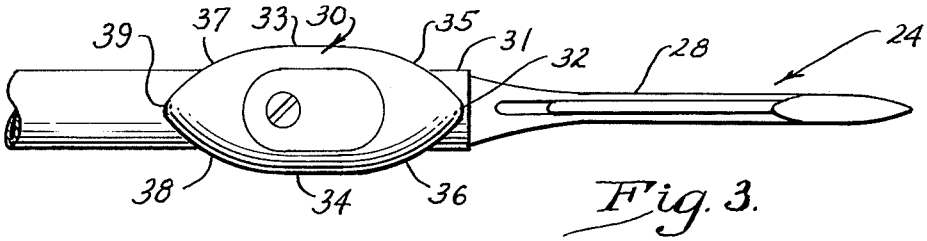
FIG. 3 is a bottom view of an exit rapier provided with guide means according to the invention.
Figure 4:
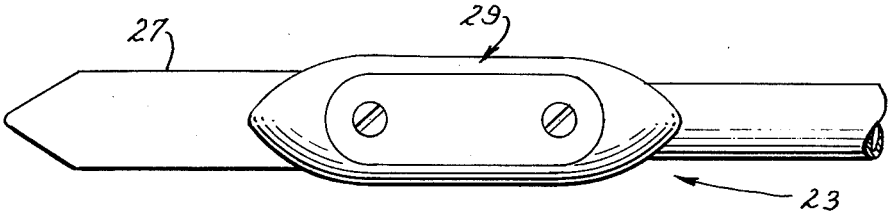
FIG. 4 is a bottom view of an entry rapier provided with guide means according to the invention.

The instant invention utilizes the sheets 18, 19 of warp strands which form the sides of the shed to stabilize the rapiers 23, 24 as they travel in the shed. A typical rapier is comprised of an elongated body portion having any of several cross-sections. The shed-penetrating fore-end of the rapier generally has an associated weft-yarn carrying rapier head which may be either an integral part of the body portion or a distinct element fixed thereto. While the rapiers described herein have a tubular body and a rapier head which is inserted in the tube, it should be understood that the invention also applies to elongated rapiers of other constructions which require stabilization while travelling in the shed. As shown in FIG. 1, warp strand sheets 18, 19 come together at the fell line 21 to form a V. Entry rapier 23 and exit rapier 24, shown in FIG. 2 but not in FIG. 1, are so constructed and positioned that portions of the rapiers form guide means which contact the inner sides of warp strand sheets 18, 19 as the rapiers travel in the shed. In the embodiment shown in FIGS. 1, 3, 4 and 7 the guide means 29, 30 for rapiers 23, 24 respectively each comprise a boat-shaped segment formed from any suitable material which is mounted on the bottom of the rapier. Referring specifically to FIG. 3, the exit rapier, indicated generally at 24, has a rapier head 28 inserted in rapir tube 31. Guide means 30 is mounted on the rapir tube 31 in any suitable manner, as by screws. Guide means 30 could be located at various points on tube 31 but is preferably mounted in proximity to head 28 so as to provide maximum rapier head stability. The front apex 32 of guide 30 tapers back and outwardly to sides 33, 34. As rapier 24 enters the shed, the rapier is guided by tapered sides 35, 36 so as to prevent snagging on the warp strands as the rapier travels toward the point of weft yarn transfer. After entry of rapier 24 into the shed, sides 33, 34 contact warp strand sheets 18, 19 so as to prevent side-to-side movement. It is preferable that sides 33, 34 barely contact the warp strand sheets 18, 19 without deforming said sheets outwardly so that the warp strands do not become frayed. Tapered sides 37, 38 taper toward rear apex 39 of guide 30 to guide the rapier through the shed during withdrawal from the shed. As shown in FIG. 4 an entry rapier, indicated generally at 23, has a similar guide 29 in proximity to rapier head 27. The configuration of guide 29 is similar to that of guide 30 and provides the same guiding and stabilizing effect when rapier 23 is travelling in the shed.

Since, as shown in FIG. 1, warp strand sheets 18, 19 come together at the fell line 21 so as to form a V, rapiers 23, 24 are effectively cradled between sheets 18, 19 so that movement in the downward direction is also inhibited. Thus, the only direction in which the rapier heads have freedom of movement is in the upward direction. Since the tendency of a cantilevered free end is to oscillate in a combination of vertical and horizontal directions, any restriction on movement in a given direction will have a dampening effect on movement in the opposite direction. Consequently, due to the fact that contact between guides 29, 30 and warp sheets 18, 19 inhibits vertical movement of rapier heads 27, 28 in the downward direction, vertical movement of the rapier heads in the upward direction is dampened even though there is no physical restriction.

Figure 5:
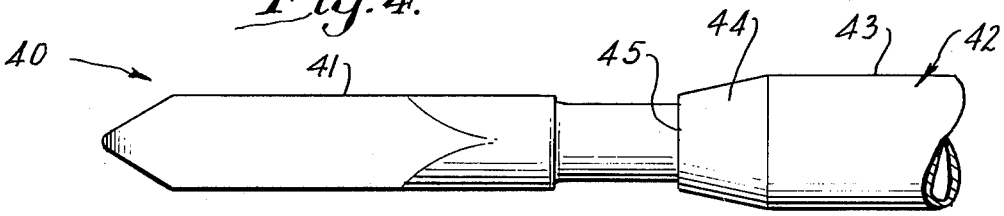
FIG. 5 is a top view of an entry rapier in which the rapier tube comprises the guide means.

FIG. 5 shows an embodiment of an entry rapier 40 having a rapier head 41 inserted in rapier tube 42 wherein tube 42 constitutes the guide means. Tube 42 has a diameter sufficiently large so that the surface 43 of tube 42 contacts the warp sheets 18, 19 as previously discussed with reference to FIG. 1. In order to provide adequate guidance in the shed, rapier tube 42 has a tapered frontal portion 44 in which the surface 43 tapers radially inward to front end 45 of tube 42. This tapered portion serves the same purpose as that described with respect to guide 30 in FIG. 3. This principal could be employed equally well with respect to the exit rapier.

Figure 6:
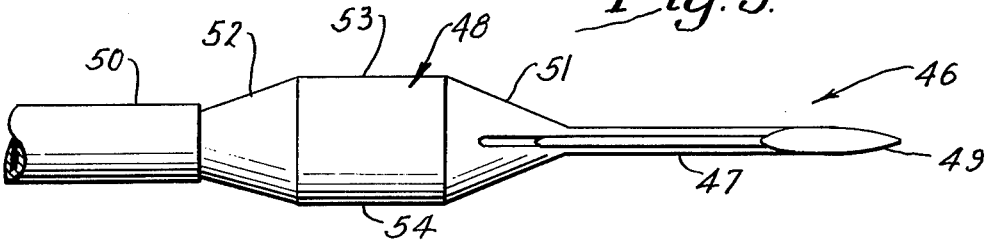
FIG. 6 is a top view of an exit rapier in which the rapier head comprises the guide means.

FIG. 6 shows an embodiment of an exit rapier 46 wherein the rapier head 47 constitutes the guide means. Rapier head 47 has a rapier guiding segment 48 between the thread carrying end 49 and the point at which head 47 is inserted in rapier tube 50. The guiding segment 48 has a tapered front portion 51 and a tapered rear portion 52 which serve to guide the rapier as it travels in the shed in a manner similar to that previously described with respect to FIG. 3. Segment 48 is designed so that sides 53, 54 are in contact with the warp sheets 18, 19 which form the shed so that stabilization is obtained as previously discussed.

The various warp sheet contacting guide means have been described as having two sides which contact the warp sheets, as in FIGS. 3, 4 and 6 or as having a circular cross-section with contact made on the circumference of the guide means, as in FIG. 5. The invention is not limited to the specific embodiments described since numerous configurations of guide means can be employed which utilize the warp strand sheets to accomplish stabilization of the rapiers.

Figure 7:
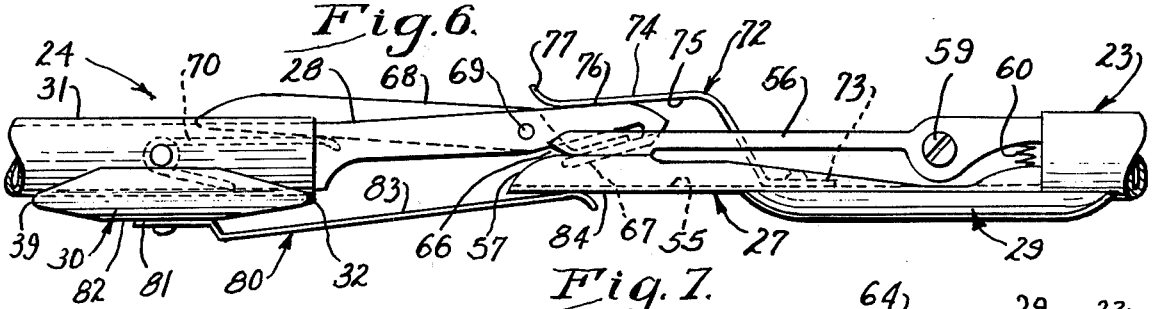
FIG. 7 is a side view of entry and exit rapiers, in the weft yarn transfer position, having clip and guide means.
Figure 8:
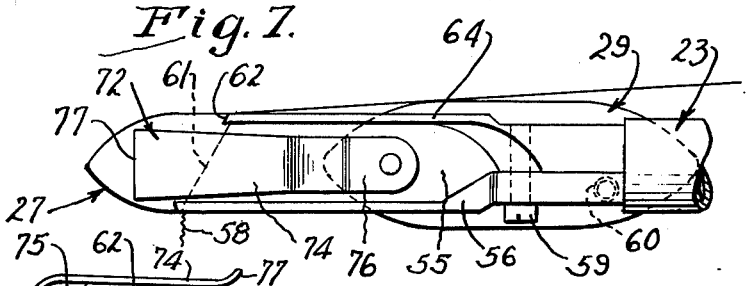
FIG. 8 is a top view of the entry rapier of FIG. 7.
Figure 9:
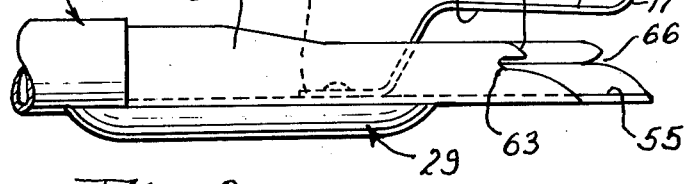
FIG. 9 is a side view, opposite to that shown in FIG. 7, of the entry rapier.

In order to further insure successful transfer of the weft yarn from the entry rapier to the exit rapier, means is provided to limit the vertical divergence of the rapiers when they come together for weft yarn transfer. Referring to FIGS. 7 and 8, entry rapier 23 is provided with a yarn gripping mechanism, spaced above the floor 55 of rapier head 27, comprised of a spring biased moving branch 56 and a stationary branch 57 which grips the weft yarn 58. Moving branch 56 is shown as pivoted at 59 and biased by spring 60. As best seen in FIG. 8, weft yarn 58 is drawn across rapier head 27 so that a seciton 61 of weft yarn 58 lies between the gripping mechanism and a yarn guide 62. Yarn guide 62 is best seen in FIG. 9. Notch 63 is located at the fore-end of wall 64 to provide means for retaining a weft yarn in proper position during transfer. The notch 63 is preferably displaced above floor 55 approximately the same distance as the gripping point 66 established by moving branch 56 and stationary branch 57. When rapiers 23, 24 come together for transfer, as shown in FIG. 7, the hook 67 of exit rapier head 28 travels over yarn section 61 between gripping point 66 and notch 63 (FIGS. 8 and 9) so that hook 67 grips the weft yarn when the rapiers 23, 24 withdraw from the shed. A suitable yarn gripping mechanism for exit rapier 24 comprises hook 67 and moving branch 68 pivoted at 69. Moving branch 68 is biased by spring 70. While the guide means previously described provide considerable stabilization and consequently greatly improved alignment at transfer, it has been noted that a degree of vertical divergence is sometime experienced which causes a missed transfer. In some cases, due to vertical misalignment of rapiers 23, 24 hook 67 may bounce upward off of the floor 55 of rapier head 27. If rapier 24 is withdrawn before hook 67 returns to the normal transfer position hook 67 will fail to catch the warp yarn. In order to limit vertical divergence of rapier heads 27, 28 a suitable retaining means, which may be a member spaces substantially vertically from the fore-end of the rapier, is provided which keeps the heads in proximity to each other when they come together. In the embodiment shown, clip 72, which can be resilient or rigid, has a base 73 which is mounted on the floor 55 of rapier head 27. Clip 72 has a substantially horizontal section 74 disposed above floor 55 at the front end of entry rapier head 27. The bottom surface 75 of section 74 contacts the top surface 76 of exit rapier head 28 when rapier heads 27, 28 come together so that proper vertical alignment is maintained during weft yarn transfer. The front end 77 of section 74 is preferably turned up to assist in guiding rapier head 28 into proper alignment with rapier head 27 and to avoid a head-on collision between clip 72 and rapier head 28.

This limitation on vertical divergence can also be obtained by providing exit rapier 24 with a clip 80 having a base 81 attached to the bottom 82 of guide 30. The top surface 83 of clip 80 contacts the bottom surface 84 of entry rapier head 27 when the rapier heads 27, 28 come together thereby maintaining proper vertical alignment during weft yarn transfer.

It is readily apparent that various devices could be employed to obtain the desired limitation on vertical divergence of rapier heads 27, 28 and thus the invention is not limited to the specific embodiments disclosed herein. For example, the rapier head or the rapier tube could be so constructed that a limiting device functioning according to the disclosed principal is integral with the head or tube. Similarly, a clip of suitable configuration could be mounted on the rapiers other than in the way previously described.

I Claim:

1. A vertical weaving machine comprising means for forming a substantially vertically oriented shed by manipulating warp strands to form sheets which meet at a fell line and a weft inserting rapier, said rapier comprising an elongated member having a shed-penetrating fore-end, a rapier head associated with said shed-penetrating fore-end, and guide means having at least one surface adapted to contact the warp strand sheets above the fell line while said rapier travels in the shed whereby said rapier is guided by the warp strand sheets.

2. A vertical weaving machine according to claim 1 wherein said guide means and said elongated member are one.

3. A vertical weaving machine according to claim 1 wherein said guide means and said rapier head are one.

4. A vertical weaving machine according to claim 1 wherein said guide means comprises a guide member fixed to said rapier head.

5. A vertical weaving machine according to claim 1 wherein said guide means comprises a guide member fixed to said rapier proximate to said rapier head.

6. A vertical weaving machine according to claim 5 wherein said guide member has a frontal portion in which said contacting surface tapers toward the axis of said rapier to a front apex.

7. A vertical weaving machine according to claim 5 wherein said guide member has a rear portion in which said contacting surface tapers toward the axis of said rapier to a rear apex.

8. A vertical weaving machine according to claim 5 wherein said guide member has warp contacting sides disposed on either side of said rapier.

9. A vertical weaving machine according to claim 8 wherein said warp contacting sides taper toward one another to an apex at the frontal portion of said guide member.

10. A vertical weaving machine according to claim 8 wherein said warp contacting sides taper toward one another to an apex at the rear portion of said guide member.

11. A vertical weaving machine according to claim 1 additionally comprising a retaining member spaced substantially vertically from said fore-end to permit entry of the other of said pair of rapiers between said retaining member and said fore-end so as to limit vertical divergence of the fore-ends of said pair of rapiers when they come together for weft yarn transfer.

12. A vertical weaving machine according to claim 11 wherein a portion of said retaining member is disposed substantially horizontally above said fore-end.

13. A vertical weaving machine according to claim 11 wherein a portion of said retaining member is disposed substantially horizontally below said fore-end.

14. A vertical weaving machine according to claim 11 wherein said retaining member comprises a resilient clip.

15. A vertical weaving machine according to claim 11 wherein said retaining member is attached to said rapier head.

16. A vertical weaving machine according to claim 11 wherein said retaining member is attached to said elongated member.

* * * * *